US005221219A

United States Patent [19]

Thomson

[11] Patent Number: 5,221,219

[45] Date of Patent: Jun. 22, 1993

[54] BATTERY TERMINAL CONNECTOR

[75] Inventor: Robert Thomson, Dearborn Heights, Mich.

[73] Assignee: United Technologies Automotive, Inc., Dearborn, Mich.

[21] Appl. No.: 500,161

[22] Filed: Mar. 27, 1990

[51] Int. Cl.[5] ..... H01R 11/26

[52] U.S. Cl. ..... 439/762; 29/857

[58] Field of Search ..... 439/756, 762-766, 439/907; 29/857, 875, 885

[56] References Cited

U.S. PATENT DOCUMENTS

| | | | |
|---|---|---|---|
| Re. 26,486 | 11/1968 | Haegert | 339/230 |
| D. 249,944 | 10/1978 | Smith | D13/24 |
| D. 284,184 | 6/1986 | Carey et al. | D13/10 |
| 1,808,330 | 6/1925 | Waltz | 339/230 |
| 2,142,759 | 9/1937 | Plachy | 173/259 |
| 2,191,503 | 2/1940 | Shumway | 439/762 |
| 2,215,415 | 9/1940 | Wolcott | 439/762 |
| 2,215,416 | 9/1940 | Wolcott | 439/762 |
| 2,713,155 | 9/1953 | Anderson | 339/227 |
| 3,538,490 | 8/1968 | Juggins | 339/226 |
| 3,656,094 | 4/1972 | Haegert | 339/230 |
| 4,054,355 | 10/1977 | Kourimsky | 339/230 |
| 4,063,794 | 12/1977 | Dittman | 339/230 |
| 4,354,726 | 10/1982 | Kato et al. | 339/230 |

*Primary Examiner*—P. Bradley

*Attorney, Agent, or Firm*—Ronald G. Cummings

[57] ABSTRACT

A battery terminal connector having a molded metal body member forming a clamp portion for clamping to the terminal post of a storage battery and a base portion for connection to a primary battery cable and a non-molded metal support brace molded within the body member and having a plurality of electrical connector terminals projecting from the molded body member to provide auxiliary battery connections.

30 Claims, 1 Drawing Sheet

FIG. 1
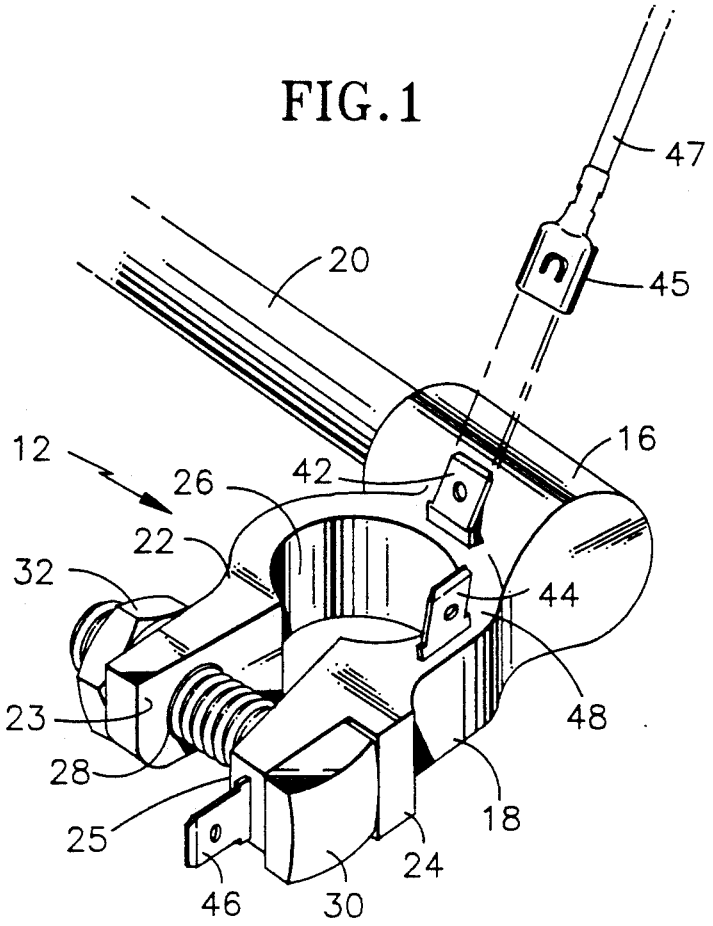
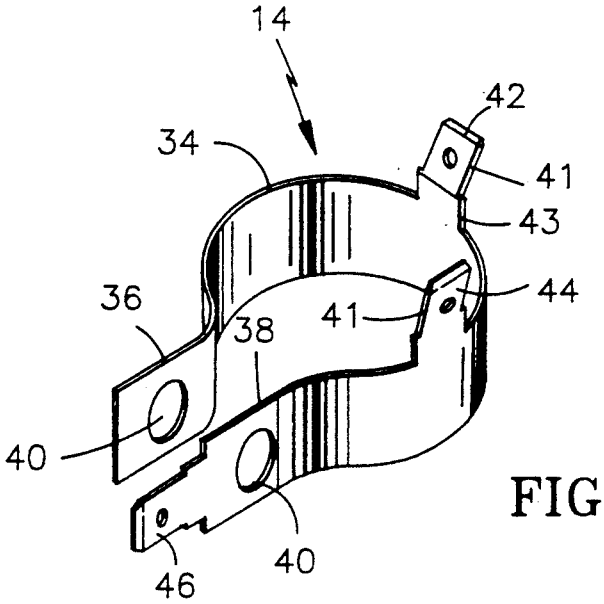
FIG. 2

BATTERY TERMINAL CONNECTOR

BACKGROUND AND SUMMARY OF THE INVENTION

The present invention relates to terminal connectors for storage batteries and more particularly to die cast battery post connectors for automobile storage batteries and the like.

Storage batteries of the type used in automobiles, trucks and the like generally have terminal posts made of lead alloy material with a cylindrical or frusto-conical shape. A conventional connector used with such battery posts is generally a U-shaped device with a nut and bolt passing through the outwardly projecting yoke-like arms for securely clamping the connector to the battery post. Exemplary connectors are shown in Waltz, U.S. Pat. No. 1,808,330 and Anderson, U.S. Pat. No. 2,713,155 which are incorporated herein by reference. Such connectors are generally die cast from lead or brass-lead alloy or other materials such as zinc alloy or copper alloy. Although other types of fabrication may be utilized such as stamped steel connectors, die cast connectors are preferable for durability and certain corrosion resistant characteristics.

Although most of the electrical equipment in an automobile is supplied from one main cable rigidly attached to the battery post connector, it is desirable to provide an auxiliary connection terminal on the battery post connector for connection of an auxiliary electrical cable. Such an auxiliary terminal may be provided for optional circuits not accommodated in the basic power distribution system or for appliances or equipment that may require quick and easy disconnection from the battery without the necessity for removing the battery post connector from the battery which may require special tools or may take excessive time in an emergency.

In prior die cast battery post connectors such as disclosed in Haegert, U.S. Pat. No. 3,656,094 issued Apr. 11, 1972 and Haegert, U.S. Pat. No. 26,486 issued Nov. 5, 1968, the auxiliary connections are inconvenient to use, unsuited for push-type connectors, and relatively costly to manufacture.

Accordingly, it is an object of the present invention to provide a new and improved die cast battery post connector with auxiliary connector terminals.

Another object of the invention is to provide such a die cast battery connector which includes a plurality of push-type auxiliary connector terminals.

Another object of the invention is to provide such a die cast battery terminal connector which is particularly strong and durable in use.

A further object of the invention is to provide such a battery terminal connector which is cost efficient to manufacture.

A further object of the invention is to provide a new and improved method of fabricating such a die cast battery connector.

Other objects will be in part obvious and in part pointed out more in detail hereinafter.

It has been found that the foregoing and related objects are attained in a battery post connector having a molded metal body member with a clamping portion for attachment to a terminal battery post and a base portion configured for rigid connection to a battery cable to provide a primary battery connection. The clamping portion has a post opening configured to receive a battery terminal post and aligned bolt receiving apertures for securing the clamping portion to the terminal post. At least one non-molded metal auxiliary connector terminal member is secured to the body member. The terminal member has a base end securely embedded in the body member and a terminal end projecting outwardly from the body member and being configured for detachable connection to a mating connector of a conductor wire to provide an auxiliary battery connection.

In a preferred embodiment, the terminal member is integrally formed with a non-molded metal support brace which is molded within the body member so that the terminal end of the terminal member projects outwardly from the body member. The support brace may have a plurality of such terminal members which are each configured to form a tab terminal adapted for detachable connection to push-type mating clip terminals.

BRIEF DESCRIPTION OF THE DRAWINGS

FIG. 1 is a perspective view of the battery post connector of the present invention attached to a primary battery cable.

FIG. 2 is a perspective view of the support brace which is molded within the battery connector of FIG. 1.

DESCRIPTION OF THE PREFERRED EMBODIMENT

Although specific forms of the present invention have been selected for illustration in the drawings, and the following description is drawn in specific terms for the purpose of describing these forms of the invention, the description is not intended to limit the scope of the invention which is defined in the appended claims.

Referring to the drawings, the battery terminal connector of the present invention generally comprises a die cast lead alloy body member 12 with a stamped steel support brace 14 cast within the body member 12. For purposes of description, the body member 12 has a base portion 16 and a clamp portion 18. The base portion 16 is generally cylindrical in shape and one end of the primary battery cable 20 is molded within the base 16 to provide a rigid mechanical and electrical connection to the battery terminal connector. Other methods of securely connecting the cable 20 to the battery terminal connector may be utilized such as threaded connectors, crimp connections, etc.

The clamp portion 18 is generally U-shaped with spaced opposing sides 22, 24 forming an opening or bore 26 therebetween configured to receive a terminal post of the storage battery. The distal ends of the sides 22, 24 have aligned bolt apertures 28 (only one of which is shown). The bolt 30 extends through the apertures 28 with nut 32 threadably mounted to the outer end so that the distal ends 23, 25 can be drawn together to reduce the size of the opening 26 and thereby securely clamp the clamp portion 12 about a battery post extending through the opening 26.

The support brace 14 is configured to the general shape of the clamp portion 12 so as to be molded within and extend through the clamp portion 12 to provide enhanced strength and durability of the body member 12. The brace 14 is generally U-shaped with a semi-circular section 34 and generally parallel planar ends 36, 38. The ends 36, 38 have aligned apertures 40 which are aligned with the apertures 28 in sides 22, 24 when the brace 14 is molded within the body member 12.

The brace 14 has terminals 42, 44 projecting from the circular section 34 and a terminal 46 projecting from the end 38. The terminal 42 is generally referred to as a tab terminal and comprises a tab portion 41 extending from a base 43. The tab portion 41 is configured for friction-fit mounting within a cooperating clip terminal 45 of conventional design shown crimp-mounted to an auxiliary power conductor 47 in FIG. 1. The terminals 44, 46 are identical to terminal 42. Operationally, the tab terminal/clip terminal combination provides a secure electrical connection that is readily and quickly attached and detached without tools. Alternately, the terminals may be configured to accommodate other types of connector configurations.

The body member 12 has opposed generally planar surfaces 48, 49 (only one of which is shown in FIG. 1) which are orthogonal to the post opening 26. The upper surface 48 is adapted to face away from the battery when the battery connector is mounted to the battery post. The tab terminals 42, 44 are configured to project outwardly from the upper surface 48 when the brace 14 is molded within the body member 12. Similarly, the tab terminal 46 is configured to project outwardly from the free end of side 18 generally orthogonal to the axis of opening 26. The positions of the tab terminals 42, 44, 46 provide convenient access for auxiliary power connection in most battery compartment configurations.

In the illustrated embodiment, the brace 44 and tab terminals 42, 44, 46 are integrally formed by metal stamping fabrication techniques. In applications where a support brace is to be utilized in a molded battery post connector, auxiliary terminals as disclosed can be provided without a significant increase in cost. Alternately, separate tab terminals can be die cast in the battery post connector where a support brace is not utilized.

In assembly, the support brace 14 is positioned relative to the body member die prior to casting so that the brace is molded within the body member 12 so only the tab terminals protrude therefrom. Consequently, the tab terminals are securely embedded and provide good electrical continuity with the body member 12 and the battery post clamped therein.

Accordingly, a die cast battery post connector has been described which provides a plurality of push-type auxiliary connector terminals and which is particularly cost efficient to manufacture and strong and durable in use.

As will be apparent to persons skilled in the art, various modifications and adaptations of the structure above described will become readily apparent without departure from the spirit and scope of the invention, the scope of which is defined in the appended claims.

What is claimed is:

1. A battery post connector device comprising:

a molded metal body member having a clamp portion for attachment to a terminal post of a storage battery and a base portion configured for rigid connection to a battery cable to provide a primary battery connection;

said clamp portion having a post opening configured to receive a battery terminal post and means for securing said clamp portion to the terminal post; and at least one non-molded metal terminal member having a base end and a terminal end, said base end being securely embedded in said body member and said terminal end projecting outwardly from said body member and being configured for detachable connection to a mating connector of a conductor wire to provide an auxiliary battery connection.

2. The battery post connector device of claim 1 wherein said terminal end is configured to form a terminal end for a push-type electrical connector.

3. The battery post connector device of claim 1 wherein said terminal end is configured to form a tab terminal adapted for detachable connection to a mating clip terminal mounted to a conductor wire.

4. The battery post connector device of claim 1 comprising a spaced second non-molded metal terminal member having a base end and a terminal end, said base end being securely embedded in said body member and said terminal end projecting outwardly from said body member and being configured for detachable connection to a mating connector of a conductor wire to provide a second auxiliary battery connection.

5. The battery post connector device of claim 1 wherein said clamp portion is generally U-shaped with first and second opposing sides forming the opening for the terminal post therebetween and having spaced free ends, said terminal end projecting outwardly from one of said free ends.

6. The battery post connector device of claim 1 comprising a plurality of spaced non-molded metal terminal members, each non-molded metal terminal member having a base end and a terminal end, said base end being securely embedded in said body member and said terminal end projecting outwardly from said body member and being configured for detachable connection to a mating connector of a conductor wire to provide an auxiliary battery connection.

7. The battery post connector device of claim 5 wherein each said terminal end is configured to form a tab terminal adapted to be detachably engaged by a mating clip terminal mounted to a conductor wire.

8. The battery post connector device of claim 1 comprising a non-molded metal support brace molded within said body member and said base end of said terminal member being connected to said brace.

9. The battery post connector device of claim 8 wherein said brace and said terminal member are of unitary construction.

10. The battery post connector device of claim 9 wherein said brace and said terminal member are of stamped metal construction.

11. The battery post connector device of claim 9 wherein said terminal end is configured to form a tab terminal adapted for detachable connection to a mating clip terminal mounted to a conductor wire.

12. The battery post connector device of claim 8 comprising a plurality of non-molded metal terminal members, each said terminal member having a base end and a terminal end, said base end being connected to said brace and securely embedded in said body member and said terminal end projecting outwardly from said body member and being configured for detachable connection to a conductor wire to provide an auxiliary battery connection.

13. The battery post connector device of claim 12 wherein said brace and said terminal members are of unitary construction.

14. The battery post connector device of claim 13 wherein said brace and said terminal members are of stamped metal construction.

15. A battery post connector device comprising:

a molded metal body member having a clamp portion for attachment to a terminal post of a storage battery and a base portion configured for rigid connection to a battery cable to provide a primary battery connection;

said clamp portion being generally U-shaped with first and second opposing sides forming a opening therebetween configured to receive a battery terminal post for clamping engagement thereto, said opposing sides having spaced distal ends with aligned bolt apertures for receiving a bolt therethrough to draw said distal ends together to clamp the body member to the battery post;

a non-molded metal support brace molded within said body member, said brace being generally U-shaped and disposed to extend through said clamp portion; and said brace having at least one terminal projection extending outwardly from said body member and configured for detachable connection to a mating connector of a conductor wire to provide an auxiliary battery connection.

16. The battery post connector device of claim 15 wherein said brace is of stamped metal construction.

17. The battery post connector device of claim 15 wherein said terminal end is configured to form a terminal end for a push-type electrical connector.

18. The battery post connector device of claim 15 wherein said terminal projection is configured to form a tab terminal adapted for detachable connection to a mating clip terminal mounted to a conductor wire.

19. The battery post connector device of claim 18 wherein said terminal projection extends outwardly from one of said distal ends of said sides generally orthogonal to said post opening.

20. The battery post connector device of claim 15 wherein said brace has a plurality of terminal projections, each terminal projection extending outwardly from said body member and configured for detachable connection to a mating connector of a conductor wire to provide an auxiliary battery connection.

21. The battery post connector device of claim 20 wherein said brace is stamped metal construction.

22. The battery post connector device of claim 21 wherein each said terminal projection is configured to form a tab terminal adapted for detachable connection to a mating clip terminal mounted to a conductor wire.

23. The battery post connector device of claim 22 wherein said clamp portion has opposed top and bottom planar surfaces generally orthogonal to said post opening, said top surface being adapted to face away from a battery when said body member is mounted to a battery post and at least one said projection extends outwardly from said top surface and at least one projection extends outwardly from one of said distal ends.

24. A method of assembling a battery post connector comprising:

fabricating a support brace configured to be molded within a die cast body member so that the brace has at least one integral electrical terminal connector member configured for detachable connection to a mating connector member, and die casting a metal body member about said brace so the brace is substantially embedded within said body member with the terminal member extending outwardly from said body member, said body member being cast so as to have a clamp portion for attachment to a battery terminal post and a base portion configured for connection to a primary battery cable.

25. The method of claim 24 wherein the step of fabricating a support brace comprises stamping a metal brace so as to have at least one projecting terminal connector member.

26. The method of claim 25 comprising stamping a metal brace so as to have a plurality of projecting terminal connector members.

27. The method of claim 26 comprising fabricating the brace of steel and die casting the body member of lead alloy material.

28. A battery post connector device comprising:

a molded metal body member having a clamp portion for attachment to a terminal post of a storage battery and a base portion configured for rigid connection to a battery cable to provide a primary battery connection;

said clamp portion having a post opening configured to receive a battery terminal post and opposed top and bottom planar surfaces generally orthogonal to said port opening, said top surface being adapted to face away from a battery when mounted to a battery post, means for securing said clamp portion to the terminal post; and a plurality of spaced non-molded metal terminal members, each non-molded metal terminal member having a base end and a terminal end, said base end being securely embedded in said body member and said terminal end projecting outwardly from said body member and being configured for detachable connection to a mating connector of a conductor wire to provide an auxiliary battery connection, and at least one said terminal end projecting outwardly from said top surface.

29. The battery post connector device of claim 28 wherein said clamp portion is generally U-shaped with first and second opposing sides forming the opening for the terminal post therebetween and having spaced free ends, and one said terminal end projecting outwardly from one of said free ends.

30. A battery post connector device comprising:

a molded metal body member having a clamp portion for attachment to a terminal post of a storage battery and a base portion configured for rigid connection to a battery cable to provide a primary battery connection;

said clamp portion being generally U-shaped with first and second opposing sides forming an opening therebetween configured to receive a battery terminal post for clamping engagement thereto, said opposing sides having spaced distal ends with aligned bolt apertures for receiving a bolt therethrough to draw said distal ends together to clamp the body member to the battery post;

said clamp portion having opposed top and bottom planar surfaces generally orthogonal to said post opening, said top surface being adapted to face away from a battery post;

a non-molded metal support brace molded within said body member, said brace being generally U-shaped and disposed to extend through said clamp portion; and said brace having at least one terminal projection extending outwardly from said top surface of said body member and configured to form a tab terminal adapted for detachable connection to a mating clip terminal mounted to a conductor wire to provide an auxiliary battery connection.

* * * * *

UNITED STATES PATENT AND TRADEMARK OFFICE

CERTIFICATE OF CORRECTION

PATENT NO. : 5,221,219

DATED : June 22, 1993

INVENTOR(S) : Robert Thomson

It is certified that error appears in the above-indentified patent and that said Letters Patent is hereby corrected as shown below:

Column 1, line 41: "U.S. Pat. No. 26,486" should be --U.S. Pat. R.E. 26,486--.

Column 6, line 21: "port" should be --post--.

Signed and Sealed this

Seventeenth Day of May, 1994

*Attest:*

Bruce Lehman

BRUCE LEHMAN

*Attesting Officer*

*Commissioner of Patents and Trademarks*